US006959806B2

(12) United States Patent
Barker

(10) Patent No.: US 6,959,806 B2
(45) Date of Patent: Nov. 1, 2005

(54) JEWELRY CASE

(76) Inventor: Deborah Barker, 6550 N. Federal Hwy., Suite 240, Ft. Lauderdale, FL (US) 33308

( * ) Notice: Subject to any disclaimer, the term of this patent is extended or adjusted under 35 U.S.C. 154(b) by 129 days.

(21) Appl. No.: 10/620,997

(22) Filed: Jul. 16, 2003

(65) Prior Publication Data

US 2005/0011774 A1 Jan. 20, 2005

(51) Int. Cl.[7] ..... A45C 11/04
(52) U.S. Cl. ..... 206/6.1; 206/566
(58) Field of Search ..... 206/6.1, 495, 566; 190/102, 107, 109–111; 383/38–40, 119

(56) References Cited

U.S. PATENT DOCUMENTS

| | | | | | |
|---|---|---|---|---|---|
| 185,181 | A | | 12/1876 | Keeney | |
| 503,355 | A | | 8/1893 | Phillips | |
| 1,183,252 | A | | 5/1916 | Sterne | |
| 3,139,133 | A | | 6/1964 | Spector | |
| 3,525,376 | A | | 8/1970 | Muhlhauser | |
| 3,777,862 | A | | 12/1973 | Zipper | |
| 4,287,986 | A | | 9/1981 | Beck | |
| 4,324,446 | A | * | 4/1982 | LeSage | 206/566 |
| 4,401,219 | A | | 8/1983 | Mink | |
| 4,735,246 | A | | 4/1988 | Niehaus | |
| 4,753,329 | A | | 6/1988 | Choy | |
| 5,020,673 | A | | 6/1991 | Adams | |
| 5,121,833 | A | | 6/1992 | Lindsay | |
| 5,209,344 | A | | 5/1993 | Smith | |
| 5,388,689 | A | * | 2/1995 | Kroop et al. | 206/214 |
| 5,511,873 | A | * | 4/1996 | Mech | 206/6.1 |
| 5,562,204 | A | * | 10/1996 | Sapyta et al. | 190/110 |
| 5,779,033 | A | | 7/1998 | Roegner | |
| 5,890,587 | A | | 4/1999 | Roegner | |
| 6,059,098 | A | * | 5/2000 | Ovadia et al. | 206/6.1 |
| 6,085,898 | A | * | 7/2000 | Ovadia et al. | 206/6.1 |

* cited by examiner

*Primary Examiner*—Luan K. Bui
(74) *Attorney, Agent, or Firm*—Mark D. Bowen, Esq.; Stearns Weaver Miller Weissler Alhadeff & Sitterson, P.A.

(57) ABSTRACT

A carrying case adapted for organizing and transporting jewelry items is disclosed. The case includes a generally rectangular main body having a plurality of flat, rectangular panels attached to the peripheral side edges thereof. The rectangular panels are foldably positionable between a compact closed configuration wherein the panels are disposed in adjacent overlapping relation within the main body to an open configuration wherein the rectangular panels are outwardly deployed. One of the rectangular panels is detachable and may be rolled into a closed configuration to permit the user to take selected jewelry items while traveling. The main body and each rectangular panel are configured with transparent pockets, ring mounting cylinders, and necklace pouches, for organizing and storing a wide variety of jewelry items including rings, necklaces, pendants, ear rings, bracelets, and other jewelry items.

16 Claims, 8 Drawing Sheets

JEWELRY CASE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to jewelry storage, and more particularly to a portable jewelry case adapted for storing, transporting, organizing, and displaying personal jewelry items.

2. Description of the Background Art

Carrying cases for use in transporting various articles come in a wide variety of shapes and sizes. Some carrying cases are specifically configured for organizing and transporting jewelry items since many jewelry owners have items that they take with them when traveling. The background art reveals a number of carrying cases designed specifically for jewelry. For example, U.S. Pat. No. 5,562,204, issued to Sapyta et al., discloses a foldable carrying case comprised of a member made up of a multiplicity of rectangular sections connected along adjacent edges by hinges thereby allowing the member to be folded from a flat configuration to a folded configuration. The inner surfaces of the sections have individual pocket-shaped storage compartments. U.S. Pat. No. 5,890,587, issued to Roegner, discloses a jewelry case consisting of a rectangular shell of pliable material that is foldable along a pair of transverse lines forming a top panel section, an intermediate panel section, and a bottom panel section. Each panel section has a pocket assembly having at least one pocket with a transparent front panel, and a first jewelry-mounting panel having a plurality of button-hole slits formed therein for detachably mounting a plurality of clip style ear rings.

In addition, the following references disclose carrying cases of various configurations:

| | |
|---|---|
| 6,267,230 - Ovadia | 4,324,446 - LeSage |
| 6,085,898 - Ovadia et al. | 4,287,986 - Beck |
| 6,059,098 - Ovadia | 3,525,376 - Muhlhauser |
| 5,779,033 - Roegner | 1,215,054 - Olney |
| 5,035,319 - Kunisch | 1,183,252 - Sterne |
| 4,799,587 - Desanto | |

There remains a need for a jewelry carrying case configured for organizing and transporting a diverse array of jewelry items. The present invention relates to carrying cases particularly adapted and configured with multiple pockets and mounting panels for organizing and transporting multiple articles of jewelry in a convenient fashion.

SUMMARY OF THE INVENTION

The present invention is a carrying case adapted for storing, organizing, transporting, and displaying jewelry. In a preferred embodiment, the case includes a generally rectangular main body having a plurality of flat, rectangular sections attached to the peripheral side edges thereof. The rectangular sections are foldably positionable between a compact closed configuration wherein the panels are disposed in adjacent overlapping relation within the main body to an open configuration wherein the rectangular sections are outwardly deployed. Preferably, at least one of the rectangular sections is detachable and may be rolled into a closed configuration to permit the user to take selected jewelry items while traveling. The main body and each rectangular section are configured with transparent pockets, ring mounting cylinders, and necklace pouches, for organizing and storing a wide variety of jewelry items including rings, necklaces, pendants, ear rings, bracelets, and other jewelry items.

Accordingly, it is an object of the present invention to provide a compact carrying case for organizing, storing, and transporting jewelry.

Another object of the present invention is to provide a jewelry carrying case for storing jewelry in an organized manner.

Still another object of the present invention is to provide a jewelry carrying case having a detachable portion for use while traveling.

DETAILED DESCRIPTION OF THE INVENTION

Figure 1:
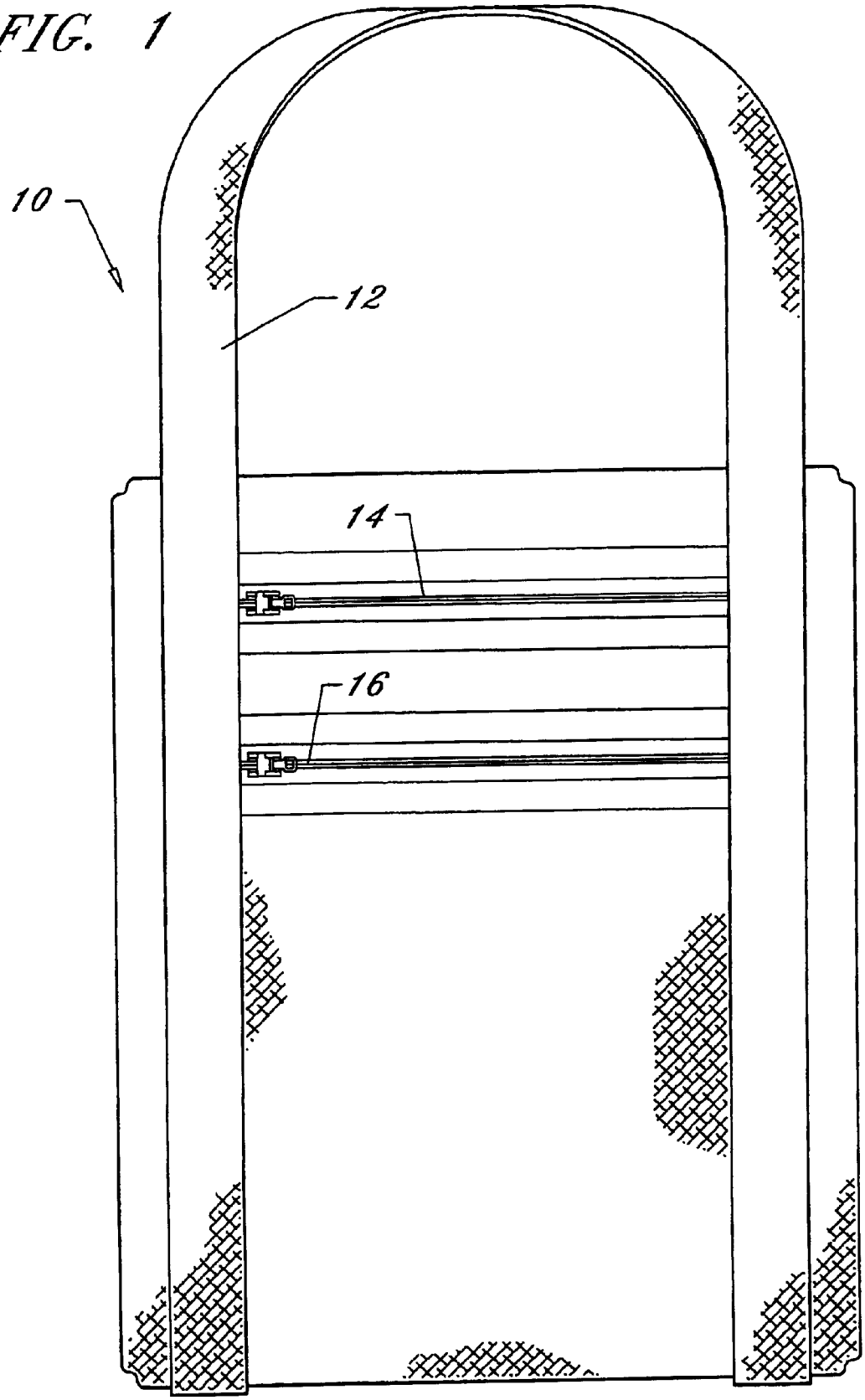
FIG. 1 is a front side elevation view of a preferred embodiment of a jewelry case according to the present invention.
Figure 2:
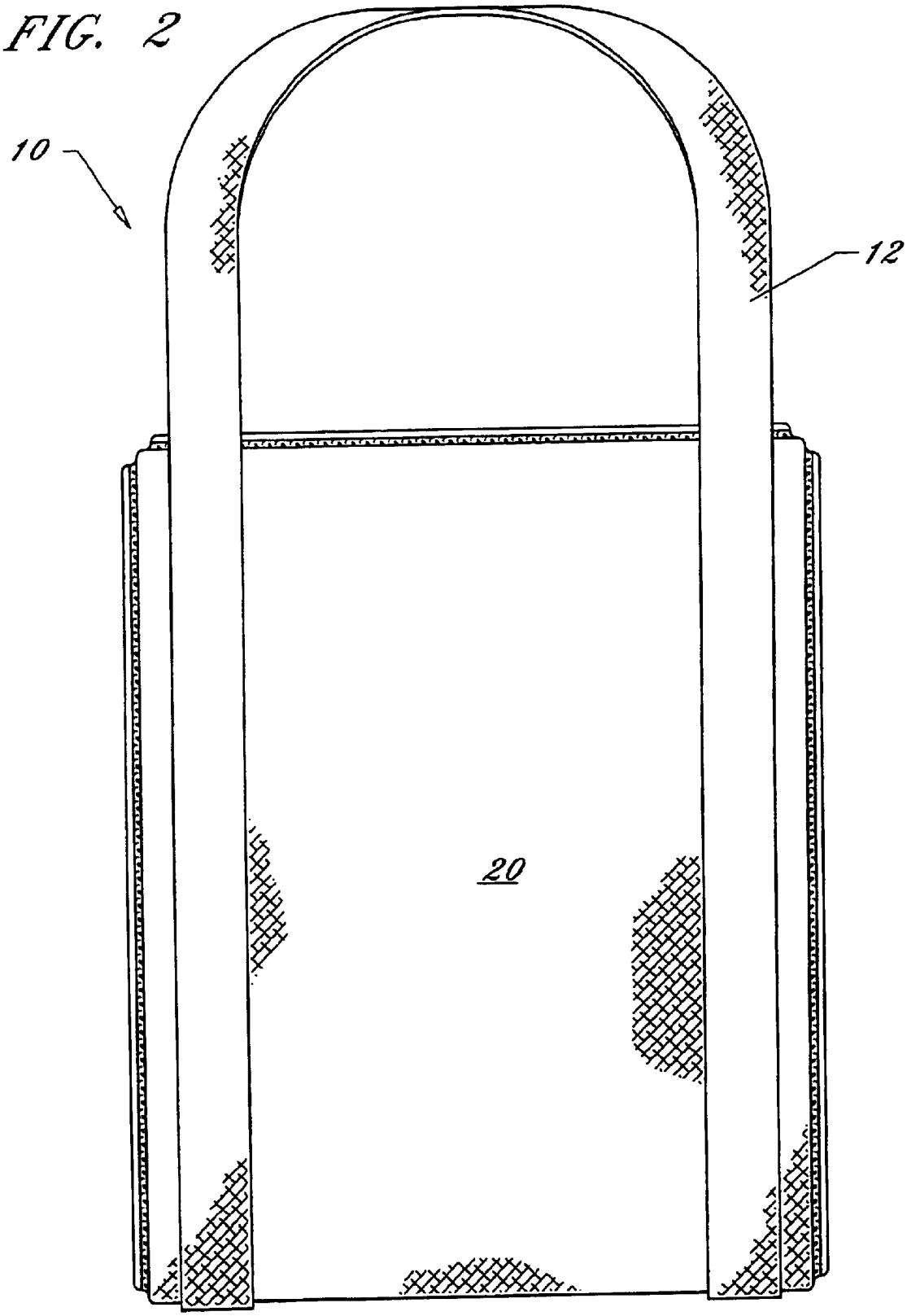
FIG. 2 is a back elevation view thereof.
Figure 3:
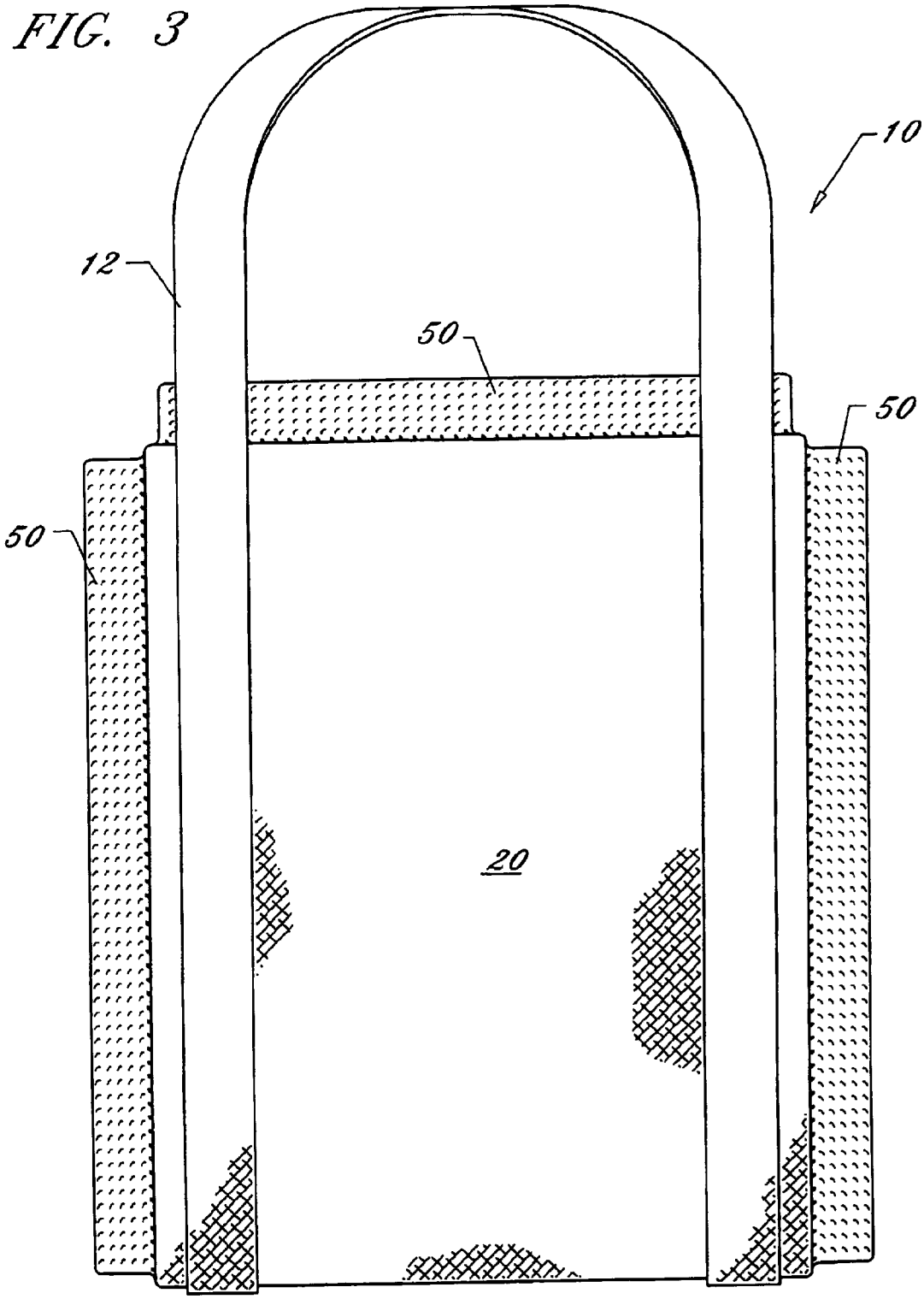
FIG. 3 is a back elevation view depicting closure flaps with hook and loop fastening material in a detached configuration.
Figure 4:
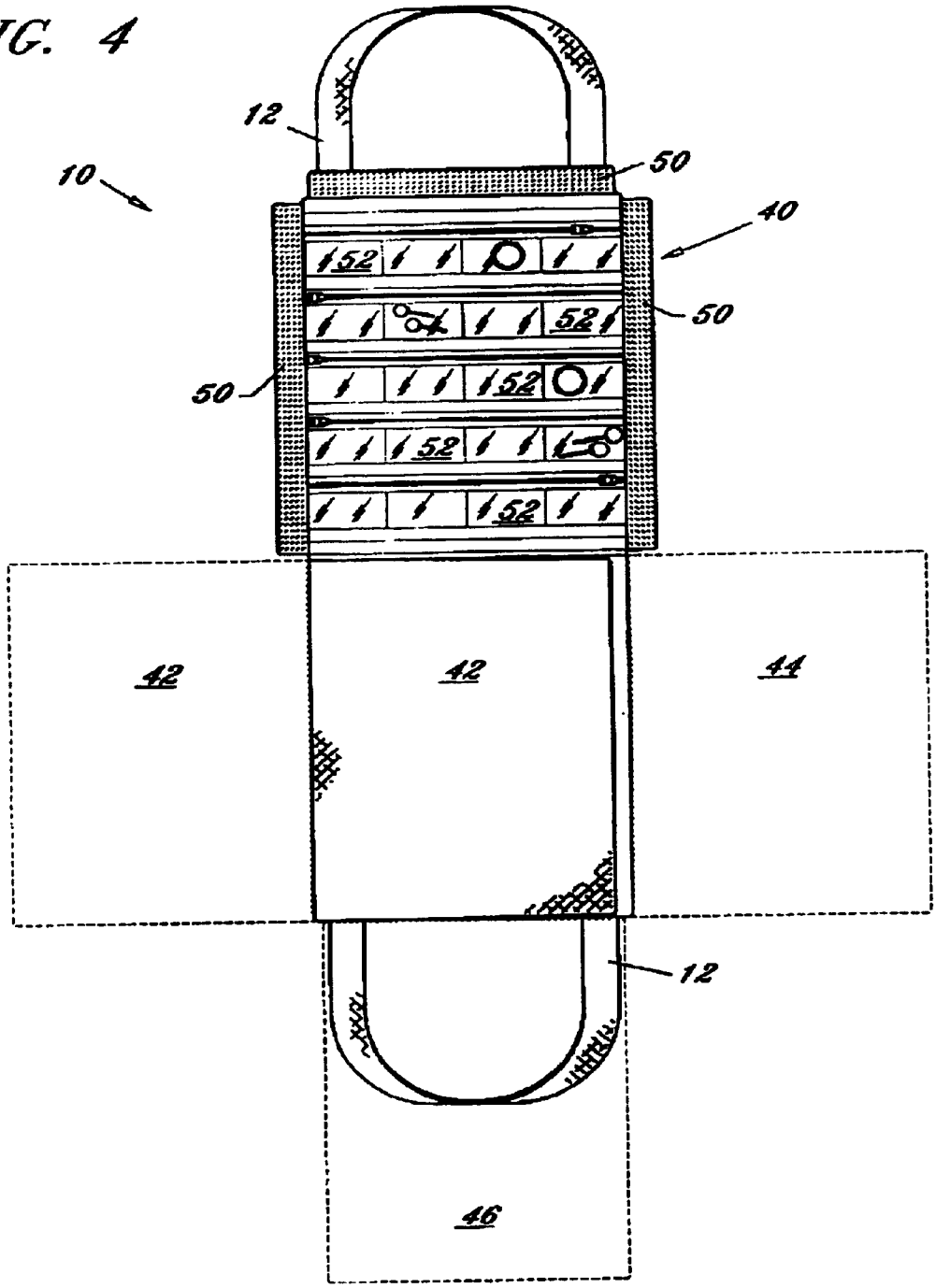
FIG. 4 depicts the jewelry case in an open configuration.
Figure 5:
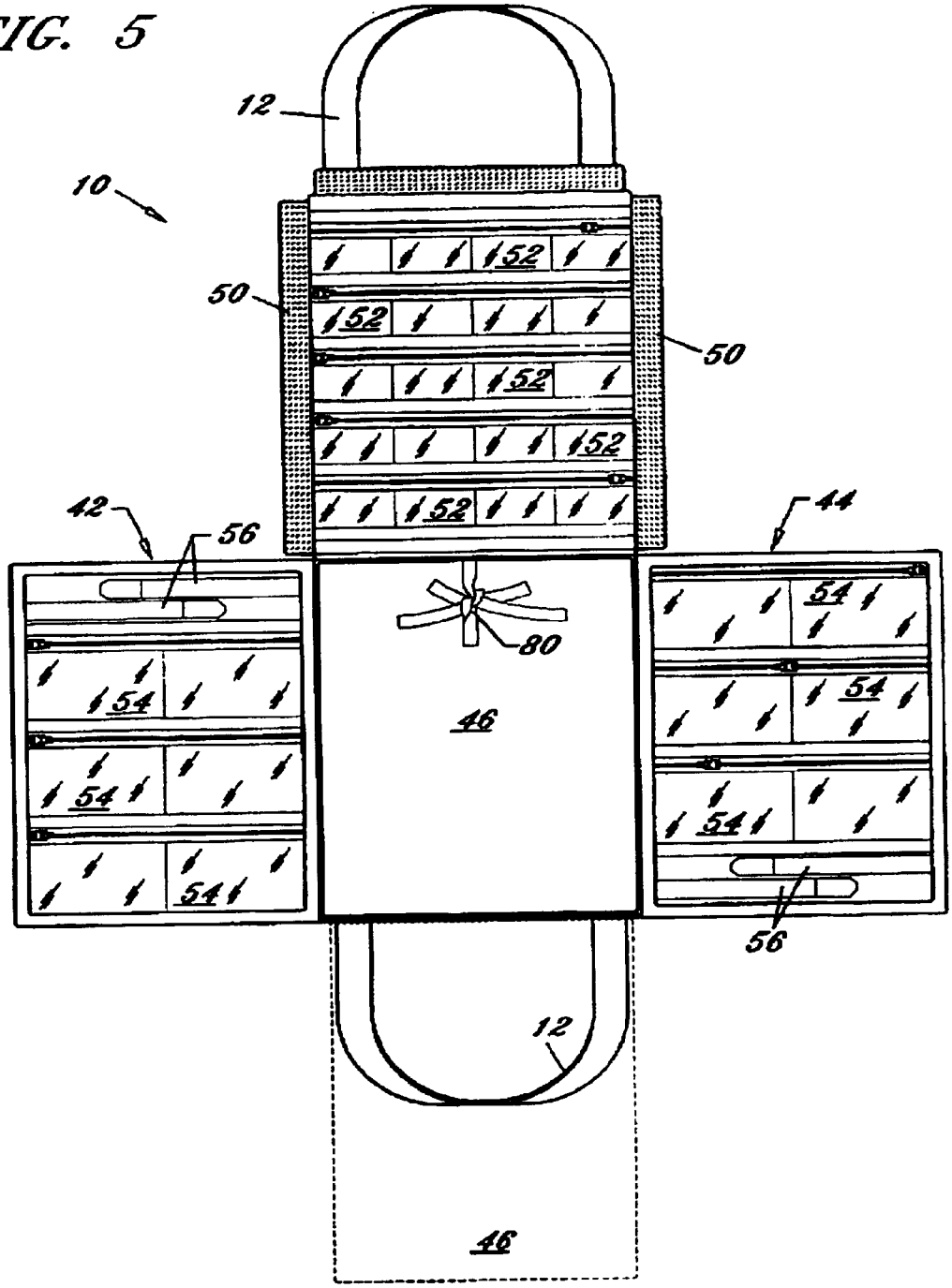
FIG. 5 depicts the jewelry case in an open configuration with the side sections deployed.
Figure 6:
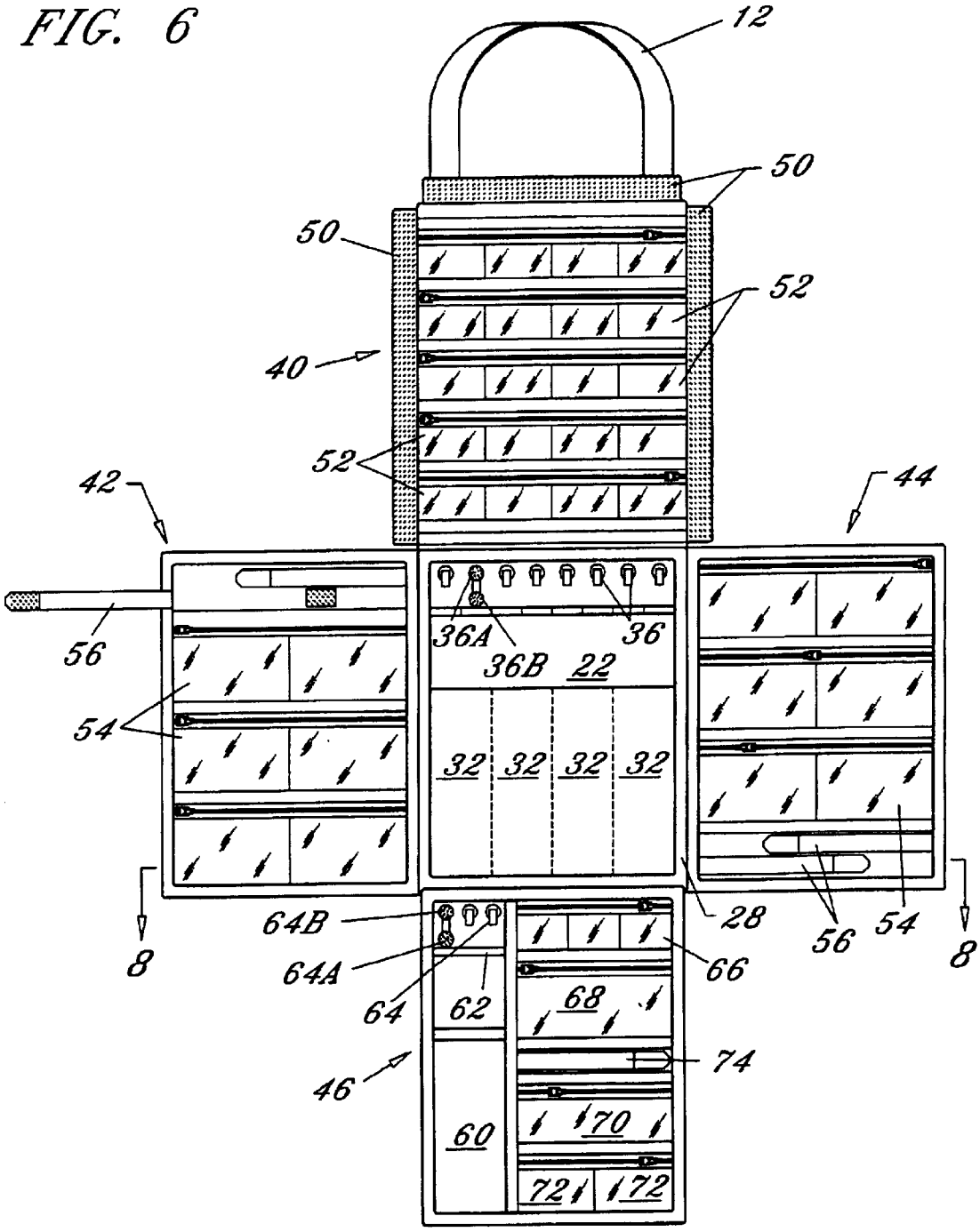
FIG. 6 depicts the jewelry case in an open configuration with all sections deployed.

Referring to FIGS. 1–7, a jewelry case in accordance with the present invention is illustrated and designated generally by the numeral 10. The jewelry case is preferably fabricated with a pliable material, such as a suitable woven fabric, leather, or vinyl, of the type commonly used in the production of hand bags, luggage, brief cases, carrying cases and the like. FIGS. 1 and 2 depict the jewelry case in a closed configuration. FIG. 3 depicts the initial steps of opening the case. FIGS. 4–6 depict the case in various partially open and full open configurations. While the preferred embodiment depicted in the drawings comprises a generally rectangular shape with generally rectangular panel members, any suitable alternate shape for the main body and/or the panel members is considered within the scope of the present invention.

Jewelry case 10 comprises a jewelry case adapted for organizing and storing jewelry items. FIGS. 1 and 2 depict jewelry case 10 in a closed configuration. As best seen in FIG. 1, case 10 includes strap members 12 forming handles, and further includes first and second externally accessible pockets, referenced as 14 and 16, having zipper closures or other suitable closing mechanism such as hook and loop fastening material, buttons, snaps, etc. Pockets 14 and 16 preferably include closeable access openings for providing convenient, readily accessible storage compartments for items frequently used.

Figure 8:
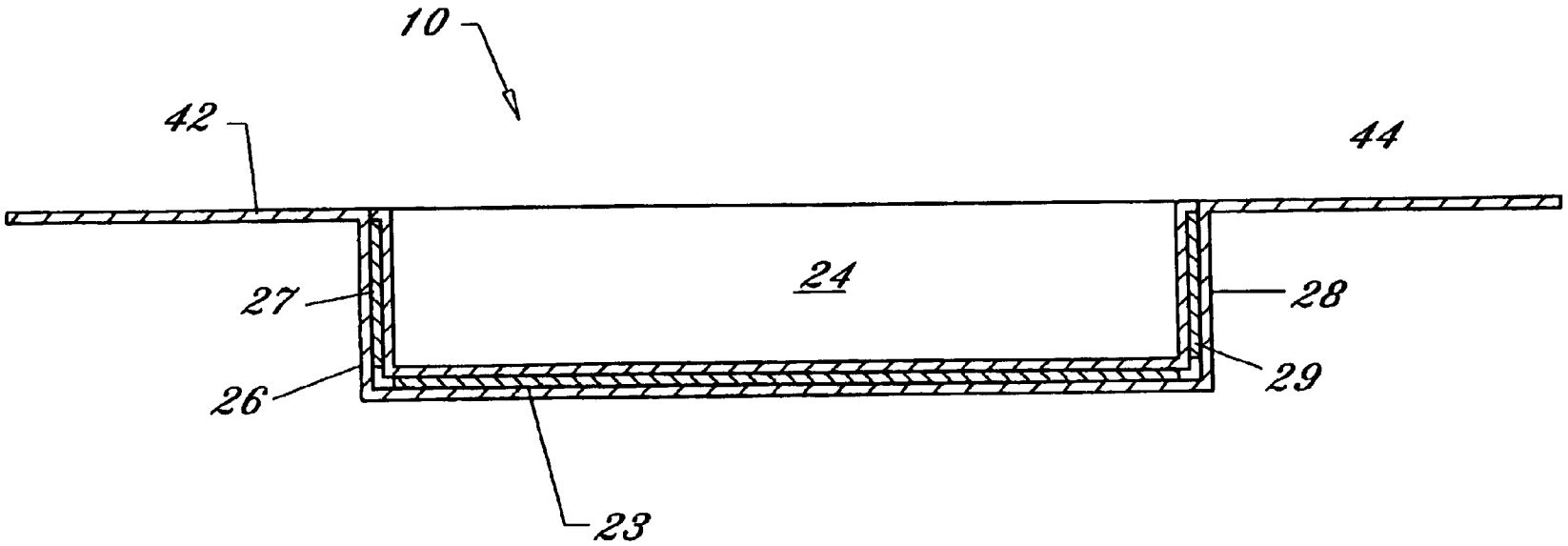
FIG. 8 is a cross-sectional view thereof of the main body portion taken along section line 8—8 of FIG. 6.

Jewelry case 10 includes a generally rectangular main body compartment 20 includes a bottom portion 22 and peripheral sides 24, 26, 28, and 30 projecting upward from bottom panel 22. Bottom panel 22 and sides 24–30, are preferably composite structures including internal generally rigid stiffening panels for providing structural integrity while protecting the contents from impact damage. It should be noted, however, that jewelry case 10 may be fabricated from any suitable material including hard or soft plastic, polymer material, etc. FIG. 8 depicts a cross-sectional view of the composite bottom panel 22 and sides 26 and 28, and illustrates stiffening panels 23, 27 and 29. The stiffening panels present in the bottom and sides of case 10 function to form a rigid shell that protects the contents from impact damage. The bottom portion 22 of main body 20 is adapted for the organization and storage of necklaces, bracelets, and other elongate items. More particularly, bottom portion 22 includes a plurality of pockets 32, retaining bands 34, and securing loops 36, for storing necklaces, bracelets, and other elongate jewelry items. Retaining bands 34 are preferably formed of an elastic material. Securing loops 36 are preferably formed of a length of elastic material having one end attached to the bottom 22 and a free end, with hook and loop fastening materials 36A and 36B attached to each end to facilitate attachment and detachment. Necklaces and the like may be secured within main body 12 by partially inserting the necklace within one of the plurality of pockets 32, routing the remainder of the necklace underneath the corresponding retaining band 34, and securing the necklace on corresponding loop 36 by detaching the hook and loop connection, routing the securing loop 36 though the necklace and placing the hook and loop fastening material in mating engagement. An optional removable panel 22A, configured to organize and store additional necklaces, may also be provided. Removable panel 22A is sized for removable insertion within main body compartment 20 in overlaying relation with bottom panel 22.

A plurality of flat rectangular panels, generally referenced as 40, 42, 44, and 46 are connected to the peripheral sides 24, 26, 28, and 30 respectively. The rectangular panels are foldably positionable between a compact closed configuration, depicted in FIGS. 1 and 2, wherein the panels are disposed in adjacent overlapping relation substantially within the main body compartment 20, to an open configuration, depicted in FIG. 6, wherein the rectangular sections are outwardly deployed.

Panel 40 functions as cover for main body compartment 20. More particularly, panel 40 includes projecting edge portions 50 adapted with hood and loop fastening material to facilitate secured closure of panel 40 on main compartment 20 by detachable engagement with corresponding hook and loop fastening material on the outside portions of sides 26, 28, and 30. Panel 40 includes rows of closable pockets, referenced as 52 disposed thereon for receiving jewelry items. The closing mechanism, referenced as 53, may comprise a zipper, button, snap, hook and loop fastening material, or any other suitable opening and closing mechanism.

Panels 42 and 44 are configured with rows of closeable pockets, referenced as 54, for receiving jewelry items. The closing mechanism, referenced as 55, may comprise a zipper, button, snap, hook and loop fastening material, or any other suitable opening and closing mechanism. Pockets 54 are preferably transparent so as to enable visual inspection of the contents. In an alternate embodiment, however, one or more pockets 54 may be opaque. In addition, panels 42 and 44 each include a pair of generally cylindrical ring mounting members, referenced as 56, for receiving rings thereon. Each ring mounting member 56 has a first end 56A connected to the corresponding panel member and a second end 56B detachably connected to the panel member by hook and loop fastening material. The ring-mounting members are preferably located on opposing (e.g. top/bottom) ends of panels 42 and 44 as depicted in FIG. 6 to facilitate compact closure of the panels in overlapping relation.

Figure 7:
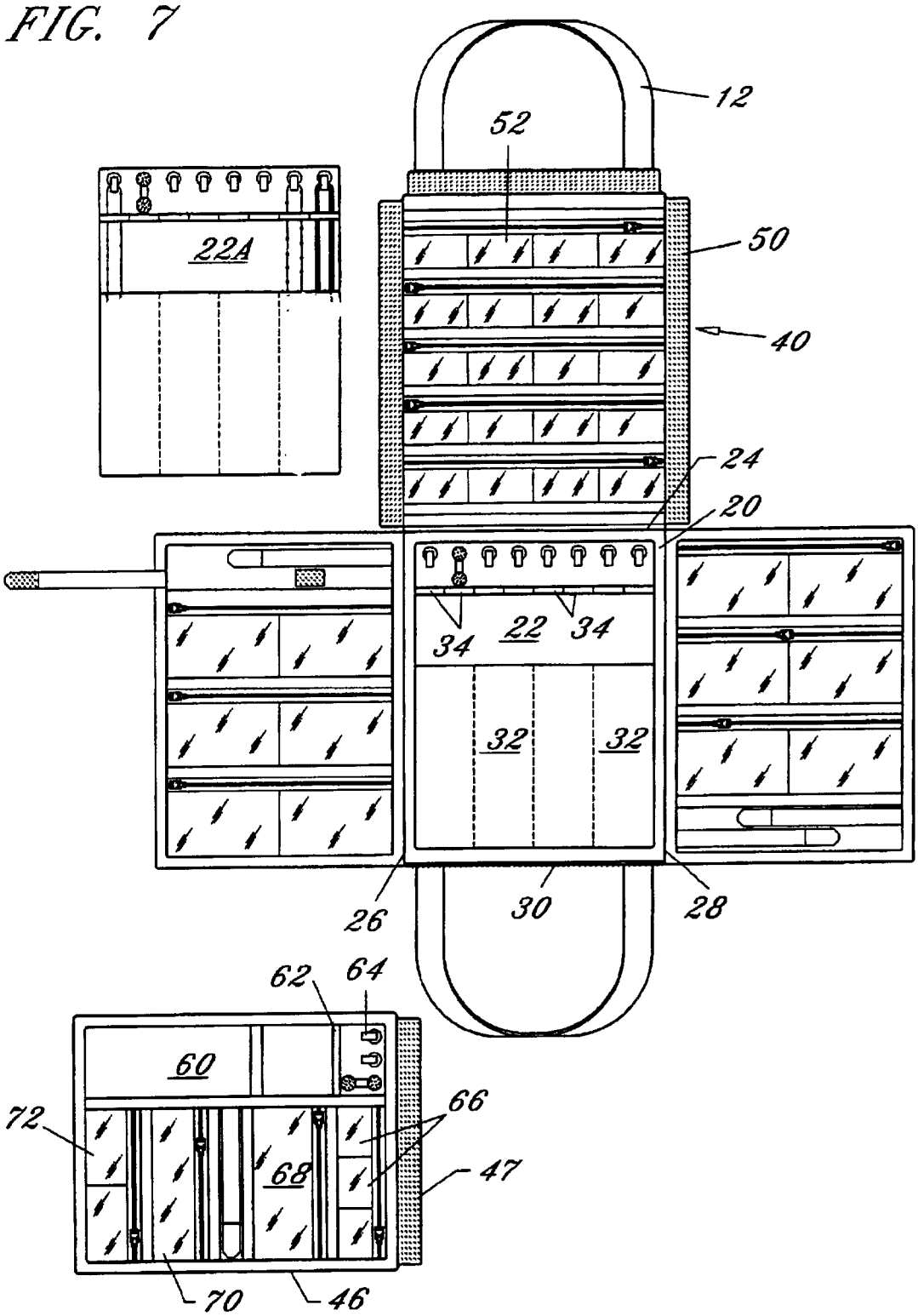
FIG. 7 depicts the jewelry case in an open configuration with one section detached from the main body.

In an embodiment wherein a case 10 is adapted with a detachable panel, panel 46 may be detachably connected to side 30 of main body 20 by hook and loop fastening material thereby enabling selective detachment of panel 46 by the user as illustrated in FIG. 7. Panel 46 is specifically configured with a variety of jewelry holding structures of the type found on the panels 22, 40, 42 and 44. More particularly, panel 46 includes a portion thereof, configured for organizing and storing necklaces, including a pocket 60, a transverse band 62, and loop members 64 adapted with hook and loop fastening materials 64A and 64B, such that at least three necklaces may be conveniently stored. In addition, panel 46 includes a portion thereof divided into a plurality of generally small closable pockets, referenced as 66, a portion thereof defining a large closable pocket 68, a portion thereof defining a medium closable pocket 70, and a portion thereof divided into two intermediate sized pockets 72. Each pocket preferably includes suitable opening and closing mechanisms, such as a zipper, button, snaps, hook and loop fastening material, or any other suitable opening/closing mechanism. Panel 46 further includes a least one ring-mounting member 74 generally centrally disposed along the length of panel 46. Ring mounting member 74 has a first end attached to panel 46 and a second end adapted with hook and loop fastening material to allow for selective attachment and detachment thereof.

As discussed hereinabove, panel 46 may be detachably connected to side edge 30 of main body 20 by an attachment structure, such as hook and loop fastening material 47. Panel 46 is suitable for use in storing jewelry items in situations wherein the user is in need of a compact case for carrying jewelry while traveling. In such situations, the user may select the desired items that he/she wishes to take along, securely store those items on panel 46 using the various pockets, necklace storing structures, and ring-mounting member, and detach panel 46 from the rest of jewelry case 10. Once detached, panel 46 may be conveniently rolled or folded into a compact tubular shape and secured by either mating hook and loop fastening material or tied by a string, referenced as 80, attached thereto.

While the preferred embodiment contemplates a single removable/detachable panel (i.e. panel 46) various alternate embodiments wherein two or more panels are removable are contemplated and considered within the scope of the present invention. In addition, while the preferred embodiment contemplates transparent pockets, e.g. pockets 52, 54, 66, 68, 70, and 72, various alternate embodiments wherein some or all of the pockets are opaque, and/or some pockets are transparent and other pockets are opaque, are contemplated and considered within the scope of the present invention.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

I claim:

1. A jewelry case for organizing, storing, displaying, and transporting jewelry items, said case comprising:

a main body defining a compartment having a bottom panel, and peripheral sides projecting upward from said bottom panel; and a plurality of panels pivotally connected to said main body and a cover panel including means for attachment to said main body in covering relation with said plurality of panels and said compartment, said plurality of panels each including means for storing jewelry; and at least one of said plurality of panels being detachable from said main body.

2. A jewelry case according to claim 1, wherein said means for storing jewelry includes closable pockets.

3. A jewelry case according to claim 2, where said closable pockets include a transparent portion.

4. A jewelry case according to claim 1, wherein said means for storing jewelry includes at least one elongate ring mounting member having a first connected end and a second detachably connected end.

5. A jewelry case according to claim 1, wherein said main body compartment is reinforced with rigid internally disposed panel members.

6. A jewelry case according to claim 1, wherein said bottom panel is adapted with means for storing jewelry.

7. A jewelry case for organizing, storing, displaying, and transporting jewelry items, said case comprising:

a main body defining a compartment having a bottom panel and peripheral sides projecting upward from said bottom panel;

said bottom panel adapted with means for storing jewelry;

a first panel connected to a first peripheral side of said main body, said first panel including means for storing jewelry items;

second and third panels connected to opposing second and third peripheral sides of said main body, said second and third panels each including a plurality of rows of pockets and at least one elongate ring-mounting member having a first connected end and a second detachably connected end; and a fourth panel detachably connected to a fourth peripheral side of said main body, said fourth panel including means for storing jewelry items.

8. A jewelry case according to claim 7, wherein said first panel includes projecting peripheral flaps including hook and loop fastening material for engagement with corresponding hook and loop fastening material disposed on outer surfaces of said main body peripheral such that said first panel may be attached to said main body in covering relation with said compartment.

9. A jewelry case according to claim 7, wherein said fourth panel includes at least one elongate ring-mounting member having a first end connected thereto and a second end detachably connected thereto.

10. A jewelry case according to claim 7, wherein said first panel's means for storing jewelry items includes a plurality of closable pockets, each of said pockets having a transparent side wall.

11. A jewelry case for organizing, storing, displaying, and transporting jewelry items, said case comprising:

a main body defining a compartment having a bottom panel and peripheral sides projecting upward from said bottom panel;

said bottom panel including means for storing necklaces;

a first panel pivotally connected to a first peripheral side of said main body, said first panel including at least one closable pocket having a transparent wall for storing jewelry items, said first panel including projecting peripheral flaps including means for releasably connecting said flaps to corresponding peripheral sides of said main body in covering relation therewith;

second and third panels pivotally connected to opposing second and third peripheral sides of said main body, said second and third panels each including a means for storing jewelry items including at least one elongate ring-mounting member having a first connected end and a second detachably connected end; and a fourth panel pivotally and detachably connected to a fourth peripheral side of said main body, said fourth panel including means for storing jewelry items, said forth panel including means for securing said fourth panel in a compact closed configuration.

12. A jewel case according to claim 11, wherein said fourth panel includes means for storing necklaces, means for storing rings, and means for storing jewelry items.

13. A jewelry case according to claim 11, wherein sad fourth panel further includes means for securing said panel in a compact roll-folded configuration.

14. A jewelry case according to claim 12, wherein said means for securing said panel in a compact roll-folded configuration comprises elongate, flexible members for securing said panel in said compact roll-folded configuration by tying.

15. A jewelry case according to claim 11, wherein said main body compartment is reinforced with rigid internally disposed panel members.

16. A jewelry case according to claim 11, wherein said first panel further includes at least one closable pocket on each opposing side thereof.

* * * * *